US007025447B2

(12) United States Patent
Kosciesza

(10) Patent No.: US 7,025,447 B2
(45) Date of Patent: Apr. 11, 2006

(54) INK CARTRIDGE HOLDER

(75) Inventor: Hary Kosciesza, Borchen (DE)

(73) Assignee: Technotrans AG, Sassenberg (DE)

( * ) Notice: Subject to any disclaimer, the term of this patent is extended or adjusted under 35 U.S.C. 154(b) by 0 days.

(21) Appl. No.: 11/032,488

(22) Filed: Jan. 10, 2005

(65) Prior Publication Data

US 2005/0151799 A1 Jul. 14, 2005

(30) Foreign Application Priority Data

Jan. 12, 2004 (DE) ..... 10 2004 001 750

(51) Int. Cl.
*B41J 2/175* (2006.01)

(52) U.S. Cl. ..... 347/86

(58) Field of Classification Search ..... 347/86, 347/87, 85; 141/385
See application file for complete search history.

(56) References Cited

U.S. PATENT DOCUMENTS 5,801,737 A * 9/1998 Sato et al. ..... 347/86
6,196,282 B1 * 3/2001 Mollers ..... 141/385
6,511,167 B1 * 1/2003 Kitabatake et al. ..... 347/86
6,843,558 B1 * 1/2005 Seino ..... 347/85

FOREIGN PATENT DOCUMENTS

| | | |
|---|---|---|
| DE | 196 32 717 | 6/1997 |
| DE | 296 02 801 | 8/1998 |
| DE | 198 54 494 | 6/2000 |
| DE | 199 53 324 | 5/2001 |
| EP | 0 716 923 | 6/1996 |

* cited by examiner

*Primary Examiner*—K. Feggins
(74) *Attorney, Agent, or Firm*—Richard M. Goldberg

(57) ABSTRACT

An ink cartridge holder for delivering ink to printing machine ink systems, includes a cover which seals the ink cartridge holder shut and allows compressed air to build up inside the holder in order to squeeze ink out of a cartridge. A locking mechanism locks the cover in the closed position and unlocks when the cover is opened. An air valve controls the delivery and extraction of air in relation to the inside of the holder, the valve being operable depending on the locked or unlocked position of the cover. A pivoting actuator independently opens and closes the cover and is contrived in such a way that, in a first phase of motion, it moves the cover into the closed position and, in a second phase of motion, locks the cover and switches the air valve, and performs an opposite operation during an opening process.

9 Claims, 6 Drawing Sheets

40
52
50
12
14
48
46
106
66
16
18

INK CARTRIDGE HOLDER

BACKGROUND OF THE INVENTION

The invention concerns an ink cartridge holder for delivering ink to printing machine ink systems, with a cover which seals the ink cartridge holder shut and allows compressed air to build up inside the holder in order to squeeze ink out of a cartridge, with a locking mechanism for locking the cover in the closed position and for unlocking when the cover is opened, plus a valve to control the delivery and extraction of air in relation to the inside of the holder, said valve being operable depending on the locked or unlocked position of the cover.

For the purpose of delivering printing ink in instances requiring only small amounts of ink it is customary to employ cartridges out of which the ink is squeezed using suitable equipment. There are various prior art squeezing devices suitable for the stated purpose, consisting, for example, of a cartridge holder which can be sealed shut by a cover. After sealing the holder, compressed air is introduced to squeeze the ink out of the cartridge through the open base of the holder. The present invention concerns a holder of this type which functions as a device for squeezing out ink.

DE 196 32 717 C2 discloses a pneumatic cartridge squeezing device of the above kind. The cover can be fixed in place on the tube-shaped holder by means of a bayonet lock. Inside the cover there is an air inlet through which compressed air can be introduced into the top portion of the holder below the cover. The ensuing cushion of compressed air presses down on the cartridge piston, driving it downward so that the ink is squeezed down out of the cartridge. This publication concentrates in particular on means for sealing an annular gap which may occur between the cartridge and the holder if the cartridge does not fit snugly in the holder. In the absence of further details, it may be assumed that the cover is placed on the holder by hand and that the compressed air is delivered and extracted manually.

DE 296 02 801 U1 also concerns a device for squeezing cartridges. Here, too, the subject is a holder which can be sealed by means of a cover. The aim is to overcome sealing problems to permit squeezing of cartridges of different formats. The operations to close the cover and control the compressed air are apparently manual.

EP 716 923 B1 describes another squeezing device for cartridges comprising a cylindrical holder which can be sealed by means of a flap cover to which a compressed air line can be connected. The flap cover is apparently closed and opened by hand. The process of delivering and extracting the compressed air is also manual.

DE 198 54 494 C2 describes another cartridge holder with a cover for sealing the latter and a valve for delivering compressed air through the cover. This document focuses primarily on operating safety. Hence the idea is to ensure that compressed air can only be delivered when the cover is properly closed, and that the cushion of compressed air is properly reduced before the cover is opened. With this in mind a valve is provided to control the air, said valve being connected to the cover via a control device so that the valve can be operated when the cartridge holder is closed with the cover.

All the prior art cartridge squeezing devices require a greater or lesser degree of manual intervention in order to change the cartridge. This means the printing machine has to be constantly monitored by an operator. It is not possible, even for a limited period of time, to keep ready a stock of ink greater than the volume contained in a single cartridge.

SUMMARY OF THE INVENTION

This invention is based on the task of designing an ink cartridge holder in such a way that permits substantial automation of the cartridge changing operation.

To solve this task a pivoting actuator is provided for independently opening and closing the cover, said actuator being contrived in such a way that, in a first phase of motion, it moves the cover into the closed position and then, in a second phase of motion, locks the cover and switches the air valve, and performs the opposite operation during the opening process.

The ink cartridge holder according to the invention is suitable for inclusion in a system ensuring a fully automatic supply of ink. It is possible, for example, to keep ink cartridges at the ready in a storage device and, after opening the cover of the ink cartridge holder as per the present application, to replace an empty cartridge with a full cartridge. As the opening and closing of the cover, the locking and unlocking thereof and the process of controlling the delivery and extraction of air are performed by one and the same pivoting actuator, the three processes can be coordinated in such a way that the required level of operating safety is achieved. Further details about this will be disclosed further on in the description.

The pivoting actuator preferably comprises a drive cylinder with an extending piston rod fixed to a console connected with the ink cartridge holder, on which a hinge mechanism for the cover is also mounted in a first pivot axis.

The hinge mechanism comprises a hinge arm with a longitudinal hole in which there is a cross bolt connected with the piston rod, which can be locked in place in the rear end position of the longitudinal hole where it remains locked until the cover closes.

In the first phase of motion the cross bolt is fixed immobile in the hinge arm, i.e. in the latter's longitudinal hole. With the help of the piston rod, the hinge arm can thus be pivoted via the cross bolt so that the cover moves from the open to the closed position. The cross bolt cannot be unlocked until this position is achieved, allowing it to be moved forward through the longitudinal hole without any further effect on the cover.

In this phase of motion, which has been designated the second phase, the movement of the cross bolt locks the cover and switches the valve.

In detail, this preferably happens as a result of there being, attached to the hinge arm, a bearing base which can be pivoted together with the pivot arm and on which a pivot lever is mounted in a second pivot axis contrived in the bearing base parallel to the first pivot axis. The bearing base, which is rigidly connected to the hinge arm, has a longitudinal hole into which the cross bolt also penetrates. This longitudinal hole is congruent to the longitudinal hole of the hinge arm. After the cross bolt is unlocked, it is also moved forward in the longitudinal hole of the bearing base. This movement pivots the pivot lever in relation to the bearing base. The pivot lever is connected with a cover locking mechanism on the one hand and the air control valve on the other hand.

The cross bolt is preferably locked by locking the pivot lever in relation to the bearing base. As the cross bolt is rigidly connected with the pivot lever this fixes the cross bolt in place so that it cannot move in either the longitudinal hole of the bearing base or in the longitudinal hole of the hinge arm.

The entire arrangement comprising the hinge arm and bearing base is mounted in one continuous axis, the first pivot axis, on the console. It is folded down in the forward direction when the cover is closed. The cross bolt is unlocked in that when this folding down takes place, the locking pin ensuring the locking action is pushed back by an unlocking element disposed on the console.

BRIEF DESCRIPTION OF THE DRAWINGS

Preferred embodiments of the invention will be explained in more detail below with reference to the attached drawings, in which.

DETAILED DESCRIPTION

Figure 1:
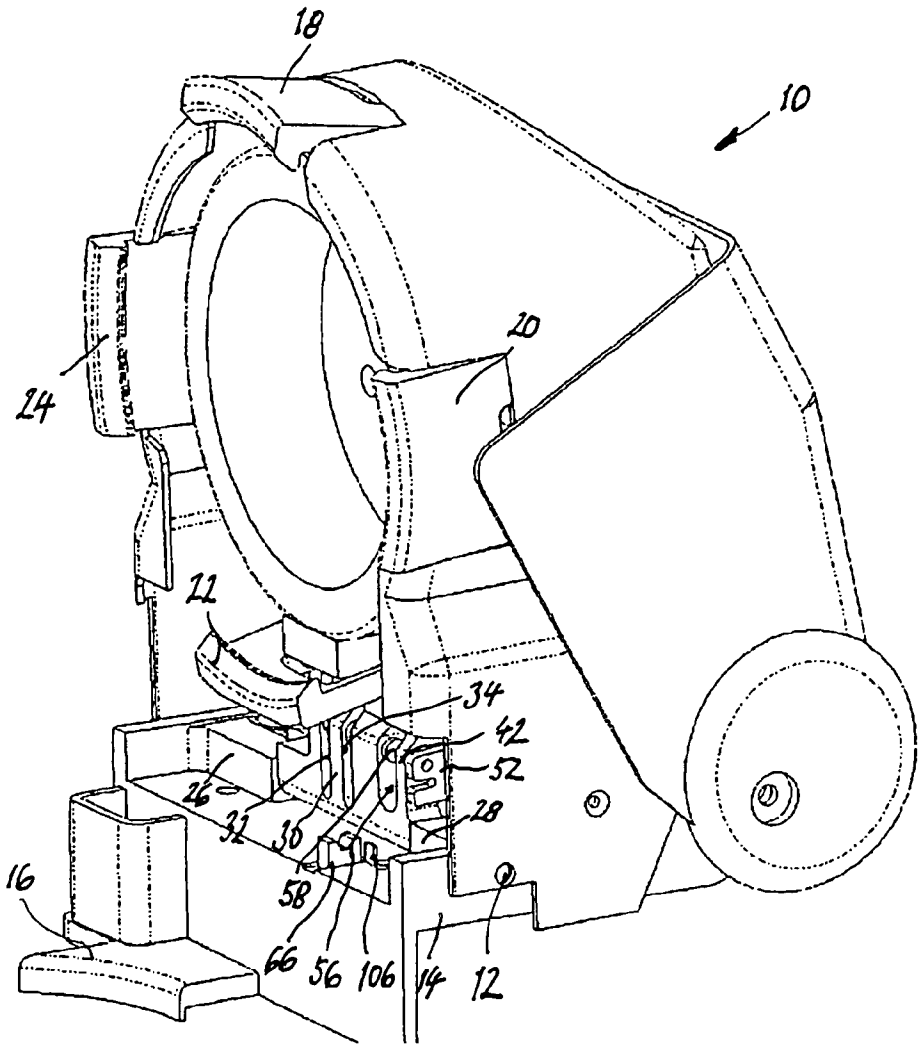
FIG. 1 is a perspective view showing the cover of a cartridge holder according to the invention in the open position.
Figure 2:
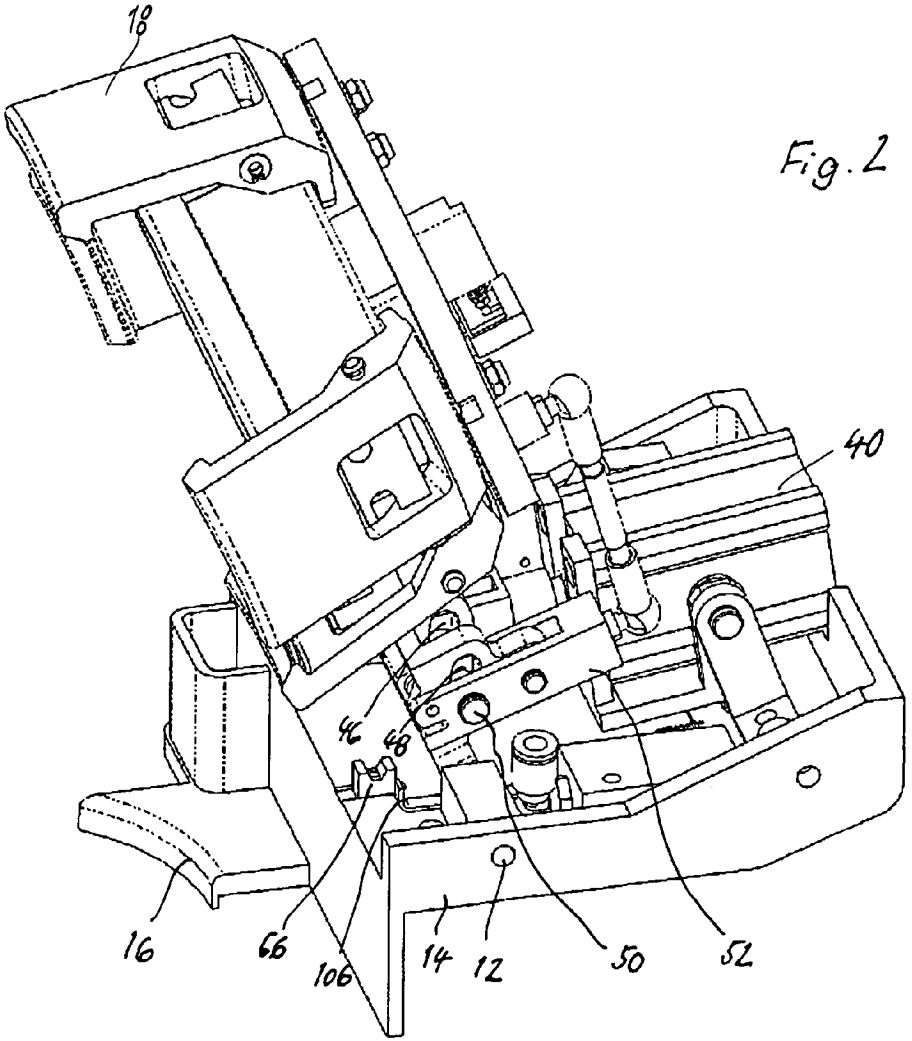
FIG. 2 is a similar view showing the cover during the closing operation.

FIG. 1 shows a cover for an ink cartridge holder according to the invention, designated as a whole by 10. Cover 10 is mounted with the help of a first pivot axis 12 on a console 14 so that it can be folded down to the left, out of the upright position shown, into a position in which it seals a holder which is not shown. The position of the holder is indicated by the arch-shaped edge line of a partially shown connecting plate 16, which rigidly connects console 14 with the holder.

It can be seen that cover 10 has four locking jaws 18,20,22,24 disposed around its periphery, which grip like claws over edge elements (not shown) on the top edge of the holder (not shown), thereby holding the cover in position on the holder. This locking mechanism will be explained in more detail below.

The first pivot axis 12 runs across the entire width of console 14 and is mounted at both ends in bearings 26,28. Located between these two bearings there is a hinge arm 30 which is rigidly connected with cover 10 through an opening in the bottom locking jaw 22, as can be at least partially inferred from FIG. 1.

Figure 4:
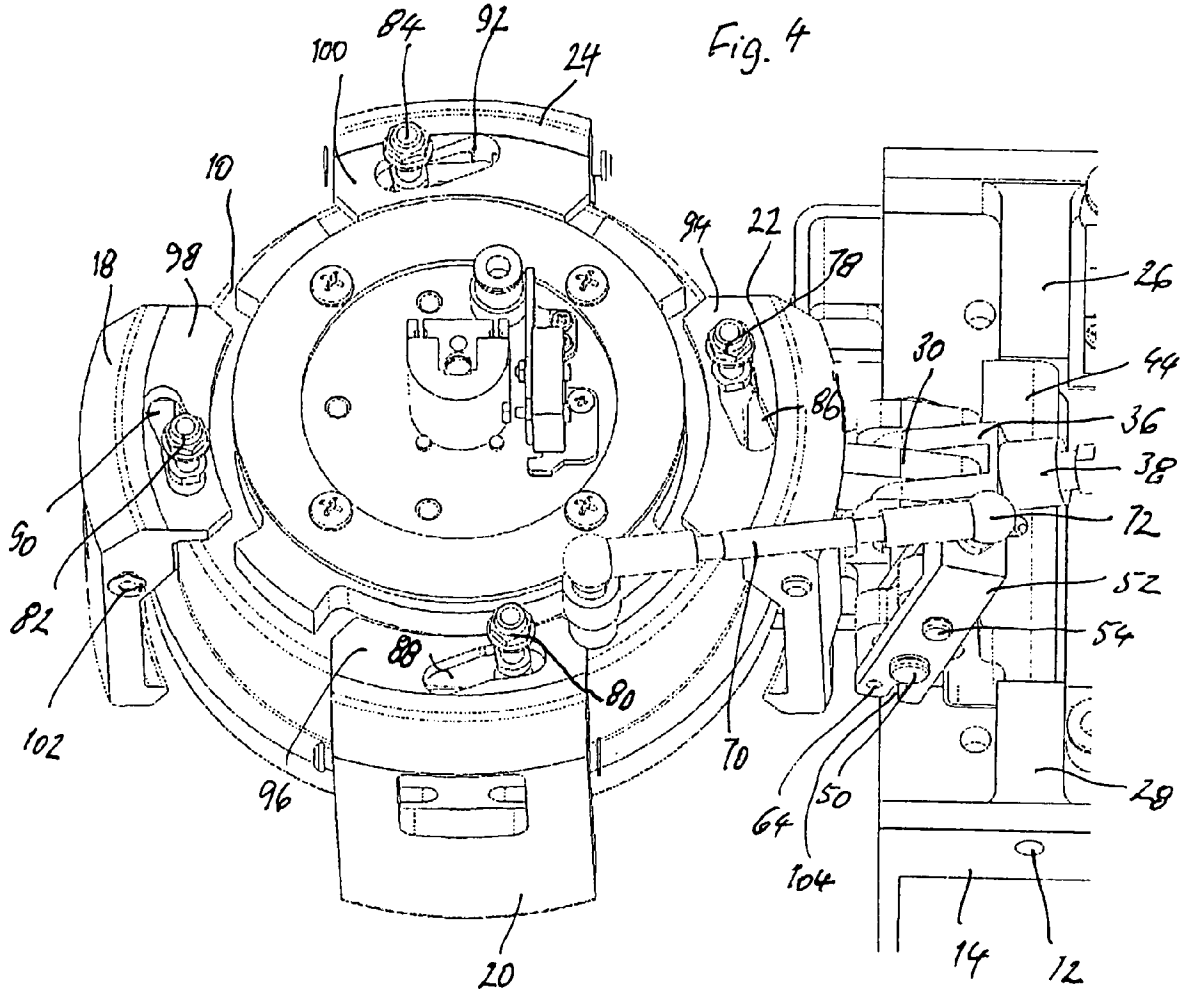
FIG. 4 is a perspective view of the cover showing key parts of a pivoting actuator for the cover according to the invention.

The hinge arm comprises three parallel elements separated by slots 32,34 into which the two fingers of a fork crown 36 penetrate (FIG. 4), said fork crown being positioned at the end of a piston rod 38 of a pneumatic cylinder 40 (FIG. 5) which constitutes the power source both for opening and closing the cover, for locking and unlocking the cover and for delivering and extracting air in relation to the holder.

Hinge arm 30 forms an integral unit with a bearing base 42, which, like the hinge arm and parallel to the latter, starts out from a common base element 44 which can be pivoted around first pivot axis 12.

Hinge arm 30 and bearing base 42 have congruent longitudinal holes 46,48, through which a cross bolt 50 runs over the entire length of the arrangement comprising the hinge arm and the bearing base.

With the help of fork crown 36 of piston rod 38, cross bolt 50 can, in certain circumstances, be moved crosswise to its longitudinal axis in longitudinal holes 46,48, as will be explained in more detail below.

When cover 10 is open, piston rod 38 is in a retracted position and cross bolt 50 rests in the rear end position of longitudinal holes 46,48 of hinge arm 30 and bearing base 42. In this position, the cross bolt is locked during the first phase of motion of the pivot mechanism according to the present invention. Hence the cross bolt is fixed immobile in the hinge arm 30 so that, when piston rod 38 is extended, it pivots hinge arm 30 around first pivot axis 12, thereby folding cover 10 down into the closed position.

To perform the second phase of motion there is a pivot lever 52 which, in relation to bearing base 42, is pivotably mounted in a second pivot axis 54 which runs parallel to the first pivot axis 12. When lever 52 is pivoted, cross bolt 50 moves in the longitudinal hole 48 of bearing base 42. Longitudinal hole 48 and hence longitudinal hole 46 as well therefore describe a circular arc around the second pivot axis 54.

Figure 6:
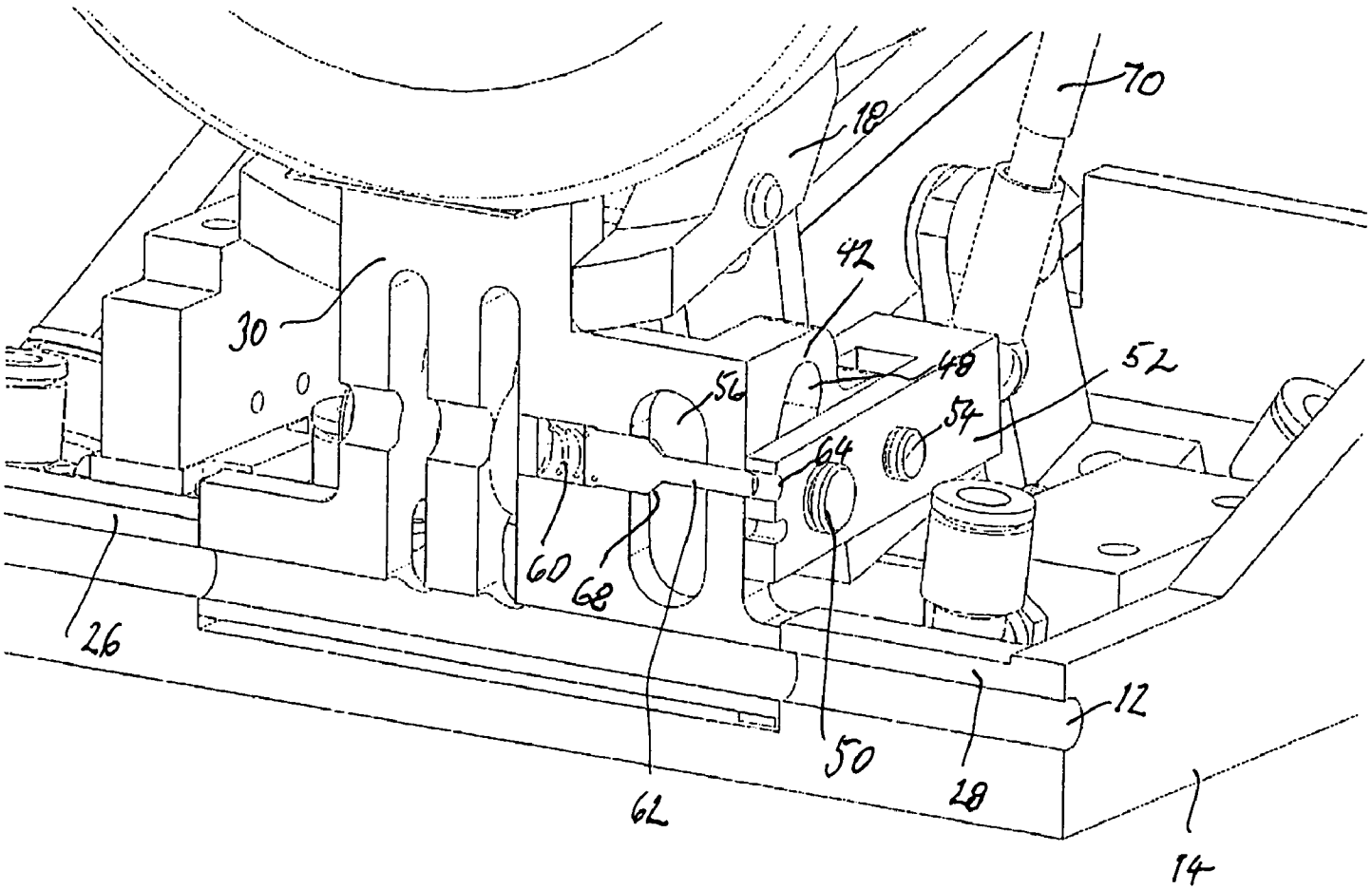
FIG. 6 is a perspective, partially cutaway view of key parts of the pivoting actuator for the cover.

To lock cross bolt 50 in relation to longitudinal holes 46,48, in which it is displaceably disposed crosswise to its axis, the pivot movement of pivot lever 52 in relation to bearing base 42 can be prevented. FIGS. 1 and 6 show how this is done.

In the side of bearing base 42 which is folded down onto console 14 when piston rod 38 is extended, there is a window 56 in which a locking bolt 58 becomes visible, which is prestressed towards the right in FIG. 6 by a compressing spring 60. In the advanced position, the relatively thin tip 62 of the locking bolt penetrates through bearing base 42 into a hole 64 in pivot lever 52. This locks pivot lever 52 in relation to bearing base 42 so that cross bolt 50 cannot move inside longitudinal hole 48. This means that cross bolt 50 is also locked in relation to longitudinal holes 46 of hinge arm 30.

Figure 3:
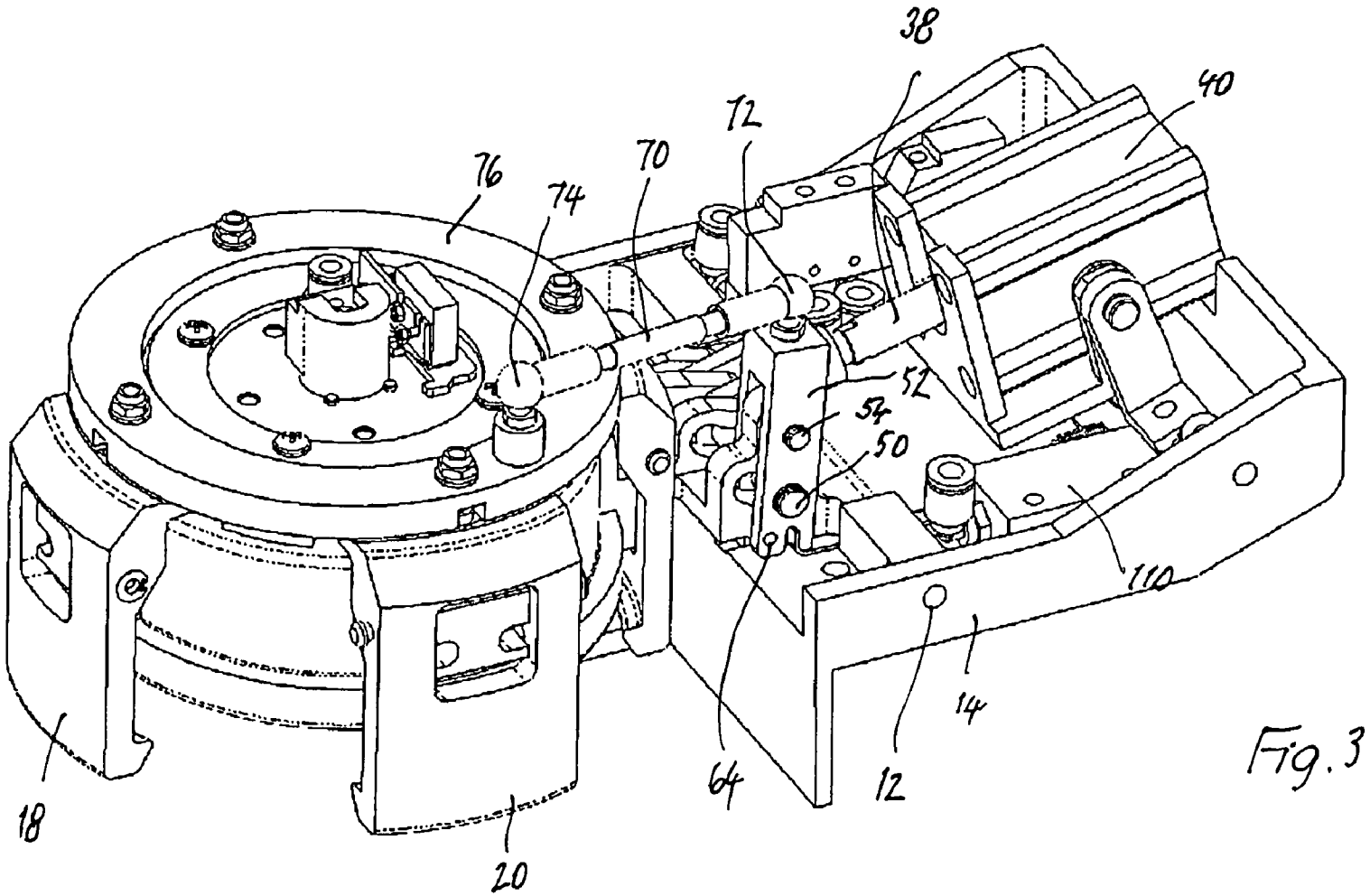
FIG. 3 shows the cover in the closed position.

On the surface of console 14 there is an unlocking block 66 with an undesignated groove with which locking bolt 58 comes into contact when bearing base 42 is folded down onto the surface of console 14. In this region, the locking bolt has a truncated cone shaped transition surface 68, which comes into contact with the left edge of the undesignated groove, and is thereby pushed back by unlocking block 66 towards the left in FIG. 6 against the pressure exerted by the compressing spring 60. This unlocks pivot lever 52 in relation to bearing base 42. When piston rod 38 is advanced further with cross bolt 50, the cross bolt is moved forward in longitudinal holes 46,48. This has no effect on the hinge arm 30 and cover 10. However, it does cause pivot lever 52 to be pivoted around the second pivot axis 54 clockwise in relation to FIG. 3 or 4. As this happens cross bolt 50 passes through longitudinal hole 48 of bearing base 42 and is at the same time moved through longitudinal hole 46 of hinge arm 30 crosswise to its longitudinal direction. The movement in these longitudinal holes does not have any effect, however, and the cover remains in its closed position.

Fixed to the top side of pivot lever 52 with the help of a ball joint 72 there a pull rod 70, which is connected on the other side with the help of a further ball joint 74 with an adjusting ring 76, which is rotatably mounted on cover 10 in a manner not shown in greater detail. In the second phase of motion of the pivoting actuator, pull rod 70 is therefore pulled to the right in FIGS. 3 and 4. Fixed to adjusting ring 76 there are guide bolts 78,80,82,84 which project vertically upwards from the adjusting ring and run in longitudinal guide holes 86,88,90,92 in top, inward-facing flanges 94,96, 98,100 in locking jaws 18,20,22,24. Locking jaws 18,20,22, 24 are swivel-mounted in horizontal axes 102 (FIG. 4) on the outer periphery of the cover. When adjusting ring 76 is rotated as mentioned, locking jaws 18,20,22,24 are clamped onto the holder and engage with counter-elements not shown here.

On the other hand It can be seen that when the adjusting ring is moved in the opposite direction, guide bolts 78,80, 82,84 first move through a concentric section of longitudinal guide holes 86,88,90,92 before the path deflects outwards to release the locking jaws.

During the opening movement, the mechanism therefore initially executes an initial leg before releasing the cover. This will be commented on in more detail below.

Figure 5:
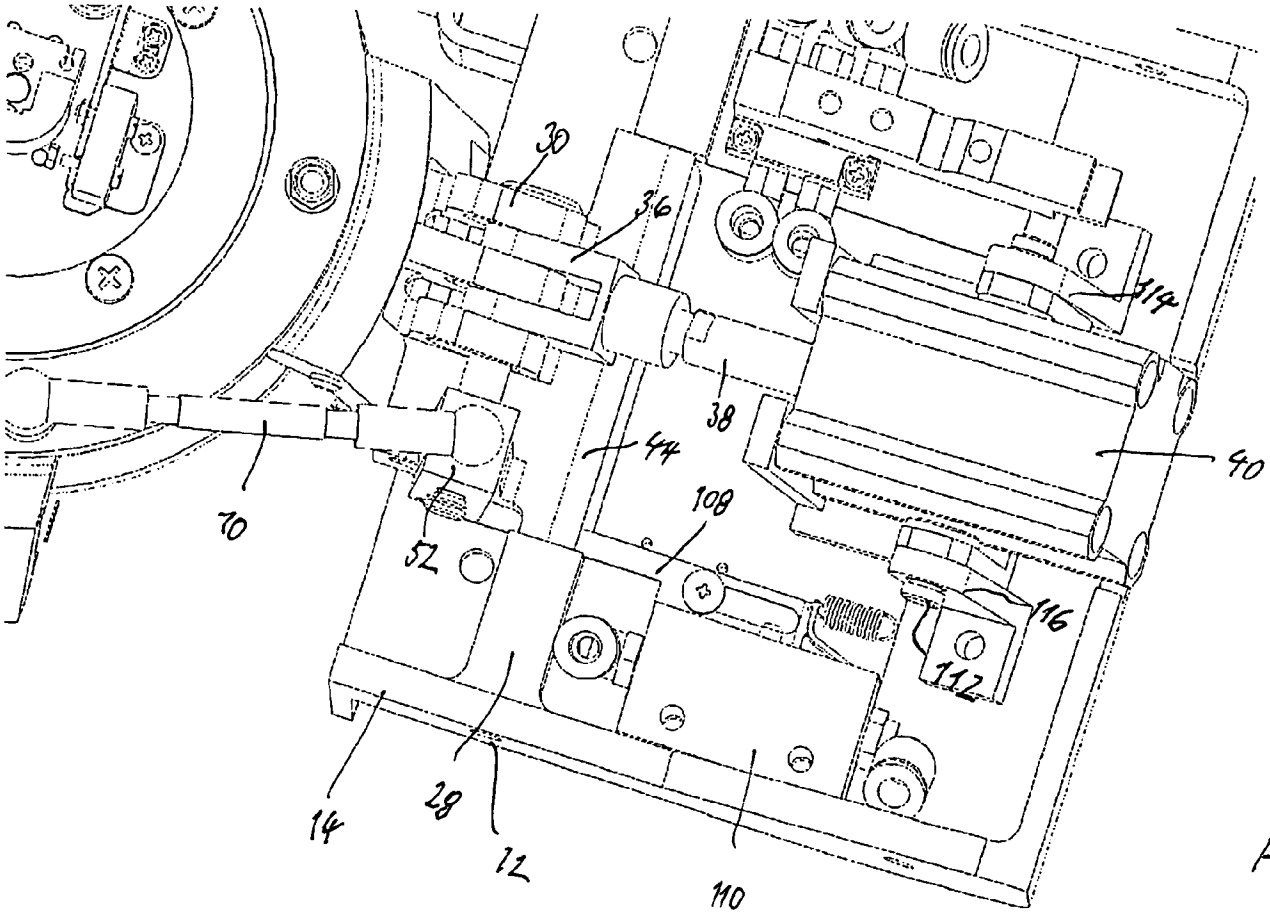
FIG. 5 is a perspective top plan view of key parts of the pivoting actuator for the cover.

When hinge arm 30 and bearing base 42 are folded forward during the first phase of motion as piston rod 38 extends, the bearing base 42, as it comes closer to the surface of console 14, comes into contact via a groove 104 on the underside of pivot lever 52, with an L-shaped end of a slide 106 displaceably mounted on the surface of console 14 (FIG. 5). This slide controls a three/two-way valve 110 which controls the delivery of air to the inside of the holder and the extraction of air from the inside of the holder.

In connection with the description of the adjusting ring it was stated that during the opening movement of the adjusting ring resp. pivot lever 52, longitudinal guide holes 86,88,90,92 first have to complete a portion of the way without the cover unlocking.

On the other hand, when pivot lever 52 is pivoted, the movement of slide 108 starts immediately, and this movement also immediately triggers the changeover of the three/two-way valve. This means the pressure in the holder is released before the cover is unlocked. Hence there is no risk of the cover flying off suddenly, possibly causing injury.

FIG. 5 shows quite clearly that the pneumatic cylinder is pivotably mounted on console 14 in a pivot axis 112 with the help of two bearings 114,116. Piston rod 38, and with it fork crown 36, can thus follow the movement of cross bolt 50 in longitudinal holes 46,48 and the pivot movement of hinge arm 30 without creating any tension.

When cross bolt 50 reaches the rear end position of longitudinal holes 46,48 during the retraction movement of piston rod 38, cross bolt 50 begins to lift hinge arm 30, and with it bearing base 42, and the associated base part 44. When bearing base 42 is lifted off the surface of the console, locking bolt 58 is released from unlocking block 66 so that it is pushed forward by compressing spring 60. As this happens, the slender tip 62 of the locking bolt enters the hole 64 in pivot lever 52. Pivot lever 52, and with it cross bolt 50, are locked in the rear end position of longitudinal holes 46,48.

The functioning of the three/two-way valve 110 does not require detailed explanation. The valve features an inlet (not shown) for compressing air and an outlet to transfer the compressing air into the cartridge holder, as well as a third outlet enabling the cushion of compressed air inside the holder to be reduced to match the ambient pressure. Appropriate connections (not shown) are provided for these purposes.

The invention claimed is:

1. Ink cartridge holder for delivering ink to printing machine ink systems, comprising:

a cover which seals an ink cartridge holder shut and allows compressed air to build up inside the holder in order to squeeze ink out of a cartridge positioned in the ink cartridge holder, a locking mechanism for locking the cover in a closed position and for unlocking when the cover is opened, an air valve to control the delivery and extraction of air in relation to the inside of the holder, said valve being operable depending on the locked or unlocked position of the cover, a pivoting actuator for independently opening and closing the cover in such a way that, in a first phase of motion, the pivoting actuator moves the cover into the closed position and, in a second phase of motion, locks the cover and switches the air valve, and performs an opposite operation during an opening process, the pivoting actuator comprising a drive cylinder with an extending piston rod mounted on a console which is connected with the ink cartridge holder, and a hinge mechanism for the cover mounted on the console along a first pivot axis, said hinge mechanism comprising a hinge arm with a longitudinal hole and a cross bolt disposed inside the longitudinal hole and connected with the piston rod of the drive cylinder, said cross bolt being locked when in a rear end position of the longitudinal hole and remaining locked until the cover closes.

2. The ink cartridge holder of claim 1, further comprising a bearing base attached to the hinge arm and which can be pivoted together with the hinge arm, and a pivot lever mounted in the bearing base along a second pivot axis parallel to the first pivot axis.

3. The ink cartridge holder of claim 2, wherein a longitudinal hole traverses the bearing base, congruent to the hinge arm for the cover and inside of which the cross bolt is also disposed.

4. The ink cartridge holder of claim 2, wherein the pivot lever can he locked in relation to its pivot movement around the second pivot axis.

5. The ink cartridge holder of claim 4, wherein the locking action is released when the hinge arm for the cover, and the bearing base, move into a forward position induced by the piston rod, in which the cover is closed.

6. The ink cartridge holder of claim 5, wherein locking of the pivot lever can be released when an arrangement comprising the hinge arm and the bearing base is folded down onto the console as the piston rod is extended.

7. The ink cartridge holder of claim 6, further comprising a locking bolt to connect the bearing base and the pivot lever under spring pressure, and which can be unlocked by an unlocking block when the arrangement comprising the hinge arm and the bearing base is folded down onto the console.

8. The ink cartridge holder of claim 4, wherein the locking of the pivot lever takes place in relation to the bearing base.

9. The ink cartridge holder of claim 2, wherein when an arrangement comprising the hinge arm and the bearing base is folded down, the pivot lever engages on a surface of the console with a slide which, when the pivot lever is pivoted, executes a longitudinal movement in order to control a valve.

* * * * *